US005757269A

United States Patent [19]

Roth et al.

[11] Patent Number: 5,757,269

[45] Date of Patent: May 26, 1998

[54] LATCH MONITOR

[75] Inventors: Thomas E. Roth, Reno; Dennis E. Wojdan, Sparks, both of Nev.

[73] Assignee: Securitron Magnalock Corp., Sparks, Nev.

[21] Appl. No.: 763,360

[22] Filed: Dec. 11, 1996

[51] Int. Cl.[6] ..... E05B 45/06

[52] U.S. Cl. ..... 340/542; 340/545; 292/340; 292/DIG. 60; 200/61.68

[58] Field of Search ..... 340/542, 545, 340/549; 292/340, DIG. 60, 144, 201, 341.16, 341.18; 200/61.68, 61.64, 61.67

[56] References Cited

U.S. PATENT DOCUMENTS 4,248,463 2/1981 Hand ..... 292/340
4,465,997 8/1984 Hines ..... 340/542
5,065,136 11/1991 Frolov et al. ..... 340/545
5,243,325 9/1993 Marin et al. ..... 340/545
5,257,841 11/1993 Geringer et al. ..... 292/340

*Primary Examiner*—Jeffery Hofsass
*Assistant Examiner*—Nina Tong
*Attorney, Agent, or Firm*—Gregory J. Nelson

[57] ABSTRACT

A closure latch or bolt monitoring device having a housing mountable in a closure frame which housing receives a latch or bolt. A pivotal rocker plate is normally biased to a rest position in which a flange portion of the rocker engages a switch connectable to an alarm system. When a latch or bolt is extended into the housing, the rocker plate is pivoted causing it to disengage from the switch providing an indication to the alarm system that the bolt or latch is properly engaged in the closure. An alternate embodiment allows separate monitoring of two lock components such as a separate bolt and latch.

5 Claims, 4 Drawing Sheets

LATCH MONITOR

BACKGROUND OF THE INVENTION

1. Field of the Invention

The present invention relates generally to alarm devices and more particularly relates to a latch monitor which provides an indication of door latch or deadbolt position to an alarm system.

2. The Prior Art

Various types of monitoring systems are available in the prior art, usable in connection with closable openings such as doors and windows and which are electrically connected to a monitoring circuit to provide an indication of the position of the closure. However, it is highly desirable to have systems of this type which will also provide the user an indication that the latch or deadbolt associated with the closure is properly engaged as it is possible that a closure, such as a door, may be shut and the deadbolt or latch not properly engaged in the strike, leaving the door other closure in an unsecured position. Because of this need, there are a number of latch or bolt security devices in the prior art as represented by the following:

U.S. Pat. No. 5,257,841, issued to Geringer et al, discloses a lock strike device which has a strike box with spaced side walls and a closed rear wall and is electrically connectable to a monitoring circuit. A first side wall and a portion of the rear define a cut-out through which an elongated blade to trigger a spring bias into the strike space. The trigger is hinged at its front end to a box connected to the front of the side wall. The rear end of the trigger comprises a head which urges a spring-loaded lever of an electrical switch mounted on the exterior of the housing rear into an open circuit position. A movable tab extends transversely into the space from the trigger and the tab senses the presence of a latch to provide a signal to an indicator. This device, while effective in many applications, requires relatively precise adjustment of the head of the trigger to insure engagement with the latch or bolt and may not always be properly performed. Also, since the switch is located on the rear of the housing, a substantial opening or aperture in the door frame is required for mounting this device. The trigger assembly also incorporates a number of precision parts increasing cost and reducing durability and reliability in use.

Another unit presently available in the commercial marketplace is the VonDuprin Model 4582 monitor strike which is manufactured by a division of Ingersoll Rand. This unit incorporates a replacement strike plate which mounts a mechanical switch behind it with a switch trigger protruding into the strike opening so that entry of the latch into the opening depresses a trigger. There are drawbacks with this unit. Installation is costly as a special cut-out needs to be made in the door frame. The manufacturing cost is high because the unit incorporates a replacement strike. Strikes are often made of expensive material such as brass or bronze for aesthetic architectural reasons. This device is located in a fixed position so that a multiplicity of units is necessary to accommodate the large number of various latches and deadbolts available on the market which are produced in different sizes and shapes and which are located in different vertical, lateral and depth positions with respect to the strike opening.

Another unit currently available is the ASSW-1048 Keeper Switch by Folger Adam. This unit addresses some of the disadvantages of the VonDuprin product. The Folger Adam unit retains the existing strike by mounting behind the existing strike. A series of slotted holes allow adjustment of the trigger switch, both vertically and depth wise to accommodate different latches and deadbolts. While this adjustment capability is advantageous as it enhances the use flexibility of the product, there is an associated drawback in that adjustment requires skilled labor and if done incorrectly will lead to a functional failure. The trigger is directly connected to the mechanical switch and rough handling of the door while the latch is engaged can damage the switch.

U.S. Pat. No. 4,465,997, entitled "Exterior Mounted Door and Window Alarm Switch", shows several embodiments of the invention and in each instance the unit is mounted on the exterior of the door frame which may be architecturally and aesthetically objectionable. Further, the installation of this unit require greater skill on the part of the installer as a precision opening must be cut into the door frame.

Accordingly, in spite of the numerous latch monitoring devices available in the prior art, there nevertheless exists a need for an improved latch bolt monitoring device which installs in a concealed manner behind the existing strike and which will work effectively with most all latches and deadbolts and which device does not require field adjustment. It is also highly desirable to have a device of this type which mechanically disconnects the associated switch from the remainder of the device when a latch or bolt is in the strike, therefore achieving maximum ruggedness and durability, as well as simplicity and low cost of manufacture.

SUMMARY OF THE PRESENT INVENTION

Briefly, the present invention provides such an improved latch or bolt monitoring device which has a rectangular housing open on one side to admit the latch or bolt. A pivot pin extends along one side wall and is mounted at opposite ends to the housing end walls. The pin pivotally supports a rocker plate which is spring biased to a rest position in which the strike plate surface of the rocker plate extends substantially across the length and width of the entire latch area opening within the housing. In the rest position, a flange engages and depresses the actuator on a switch mounted on the side of the housing to maintain the switch in a first condition. When a latch or deadbolt is extended into the latch area, the rocker plate is engaged and is pivoted further into the housing causing the flange to disengage from the actuator. This movement of the actuator changes the switch state to a second condition. In this condition, when the latch or bolt is properly within the strike area, the actuator is out of contact with the rocker plate flange so that even violent rattling of the door will not damage the switch.

In an alternate embodiment, multiple rocker plates are provided and a switch and actuator are associated with each of the rocker plates. This construction allows separate monitoring of the latch and deadbolt for a lock of the type that includes both components. In the first embodiment of the invention described above, the monitoring device will monitor the position of both the latch and deadbolt, but because the device has only a single rocker plate, the switch will be moved to the second condition when either the latch or the deadbolt enters the strike opening. With the alternate embodiment, both the latch and bolt may be separately monitored. The terms "latch", "latch bolt" and "bolt" as used herein, comprehend latches and deadbolts as well as any reciprocal member that is engageable in a locking device.

BRIEF DESCRIPTION OF THE DRAWINGS

The above and other objects and advantages of the present invention will be more fully appreciated and understood from the following description, claims and drawings in which:

DETAILED DESCRIPTION OF THE INVENTION

Figure 5:
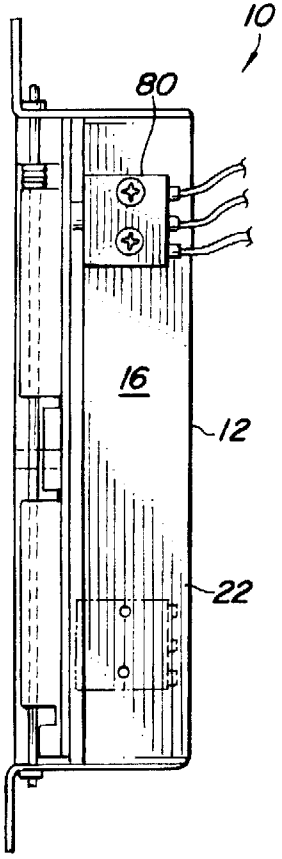
FIG. 5 is a side view of the latch monitor of FIG. 1.

Turning now to the drawings, particularly FIGS. 1, 3A, 3B, and 4 to 6, the latch monitor 10 of the present invention is shown. The latch monitor includes a box-like housing 12 having a side wall 14, an opposite rectangular side wall 16 having a height slightly less than wall 14, end walls 18 and 20, and rear wall 22. Mounting tabs 24 and 26 are integrally formed with end walls 18 and 20, respectively, and are bent to form right angles with respect to the end walls. Elongate slots 25, 25A are provided in tabs 24, 26. The housing may be of any suitable material such as a rigid, durable plastic material fabricated by injection molding or may be metal suitably formed by stamping and bending operations. The housing defines an interior strike area 30 into which the latch and/or bolt extends when properly engaged.

Figure 4:
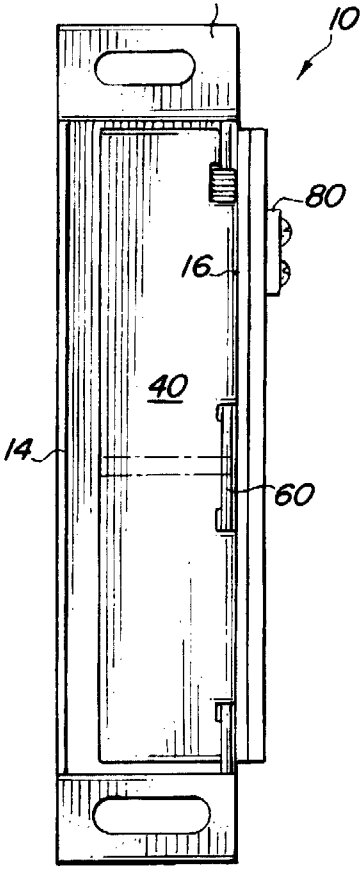
FIG. 4 is a front view of the latch monitor of FIG. 1.
Figure 6:
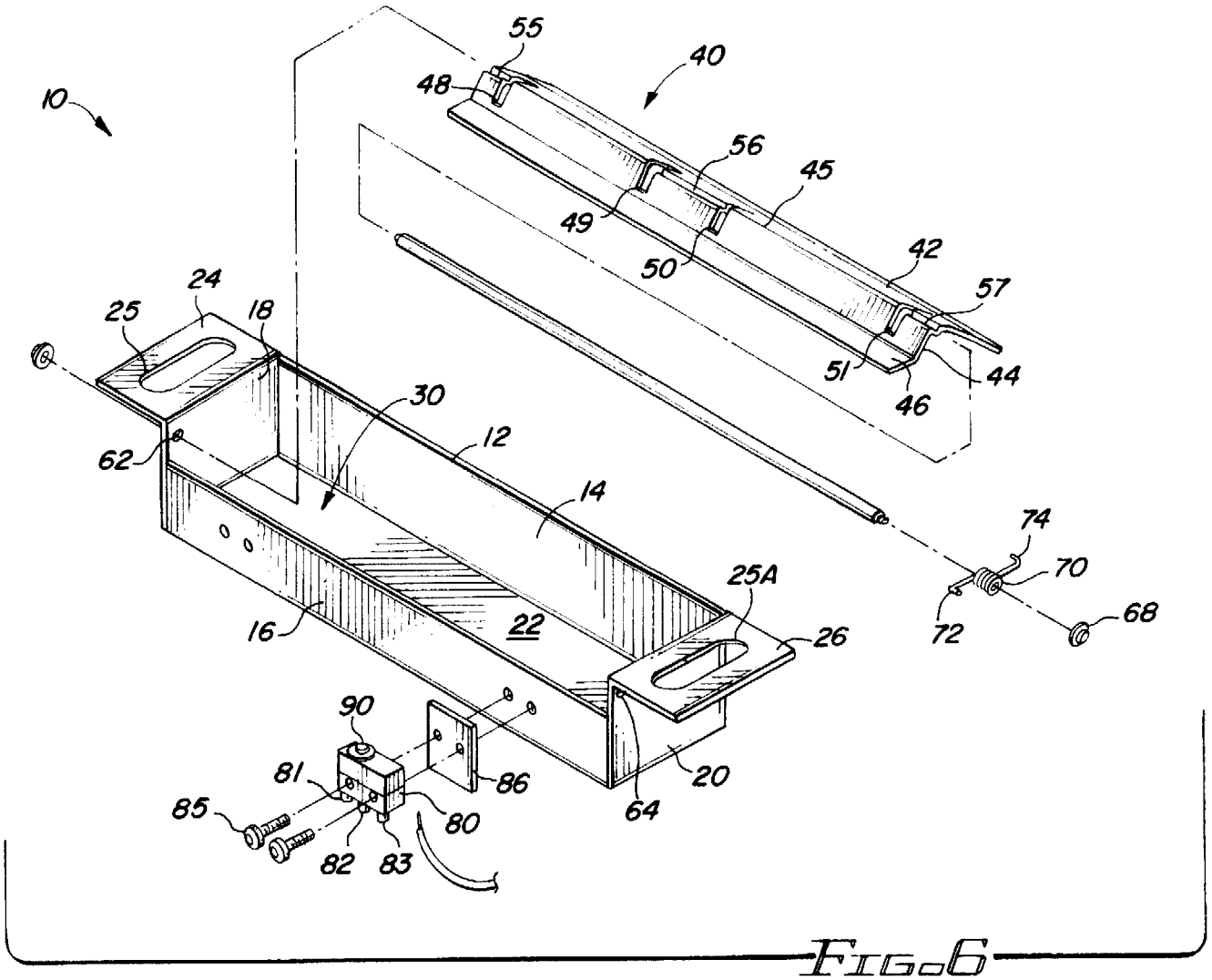
FIG. 6 is an exploded perspective view of the latch monitor of FIG. 1.

A rocker plate, generally designated by the numeral 40, is integrally formed from a single piece of material such as stamped from a light gauge steel or aluminum. The rocker plate has a planar strike plate 42 having a flange 44 which extends generally at right angle with respect to the strike plate surface. The distal edge 46 of flange 44 is bent outwardly forming an L-shape. As best seen in FIGS. 4 and 6, relieved areas 48, 49, 50 and 51, are provided at spaced-apart locations along the intersection of the flange and strike plate. Recesses are provided at locations 55, 56 and 57 along the edge so that an axial pivot pin 60 may be axially inserted through the rocker plate along recesses 55, 56 and 57. The opposite ends of the pin 60 extend beyond the ends of the rocker plate 40 and are received in apertures 62, oppositely positioned in end plates 18 and 20. The pivot pin is secured in place by slip-on type retainer nuts 68 which engage the outer surface of the end walls 18 and 20.

A coil spring 70 having opposing arms 72, 74 is positioned about the pivot pin in one of the relieved areas, as for example, registering with area 51. One of the legs 72 is positioned in engagement with side wall 16 of the housing and the opposing arm 74 is placed in engagement with the underside of the rocker plate. In this way, a light biasing force is applied to the rocker plate in the direction of the arrow shown in FIG. 3A which maintains the rocker plate in this position at rest.

Mounted on the outer surface of side wall 16 is a switch 80 which may be a microswitch of the type manufactured by Honeywell or Omron. The switch carries a plurality of terminals 81, 82 and 83 to which wires may be conveniently connected to lead to an alarm system of the type manufactured by Ademco or Napco. These alarm systems are well known to those in the art and further detailed description is not necessary.

The switch 80 is secured to the side wall 16 by screws 85 and a rectangular gasket 86 may be interposed between the switch and the side wall. The switch has an actuator 90 shown as a pin which, in the mounted position, projects upwardly to a location slightly above the upper edge of side wall 16. In the assembled position, referring to FIGS. 1 and 3A, a portion of the edge of the rocker arm flange engages the actuator and the biasing force applied by spring 70 will cause the actuator to be depressed placing the switch 80 in a first state or condition. With the rocker plate in this position, which is considered the "at rest" position, the device will provide an indication to the alarm system that the closure, such as a door, is in an open position and that the associated bolt or latch is not properly seated in the strike.

Figure 1:
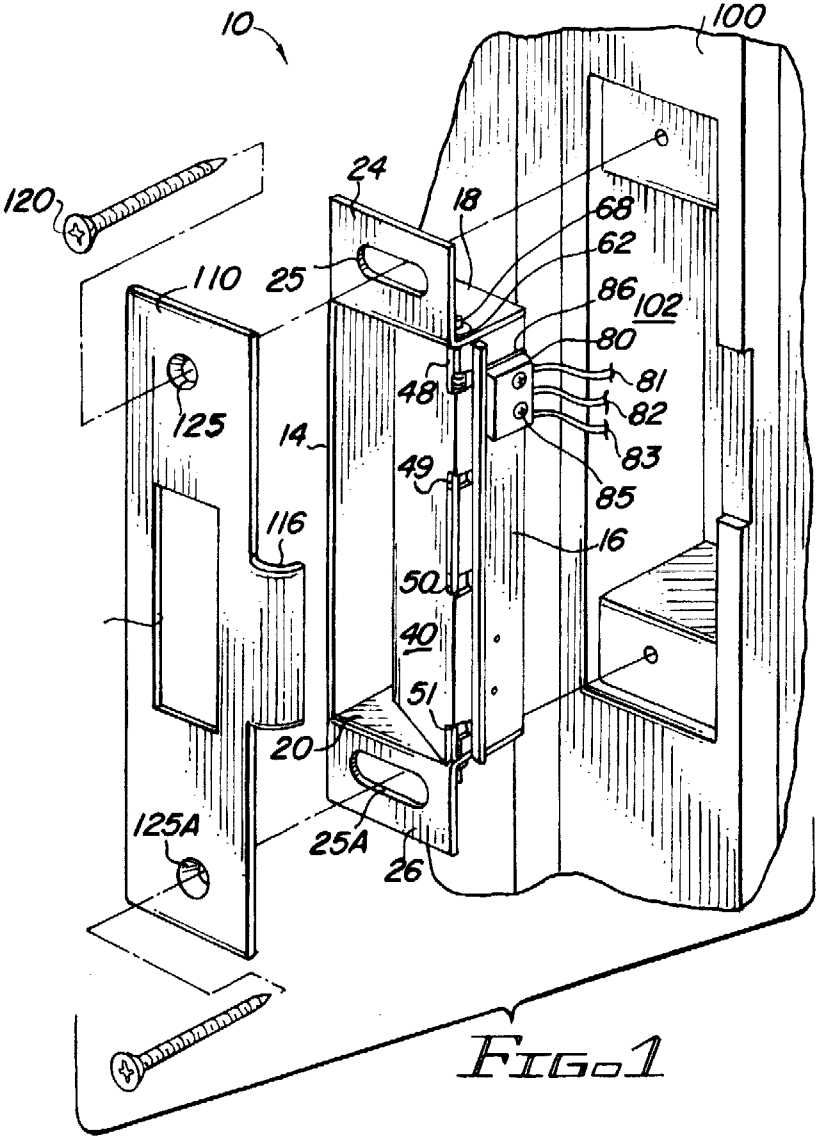
FIG. 1 is an exploded perspective view of a preferred embodiment of the latch monitor of the present invention.

FIG. 1 illustrates a typical mounting position for the latch monitor, it being understood that the latch monitor may be installed in association with any type of door or other closure. Normally, the device would be installed in a location such as a door frame 100 which is provided with a rectangular recess or cut-out 102, sized to accommodate the dimensions of the latch monitor housing 12 including sufficient lateral clearance for the side-mounted switch 80. The latch monitor is inserted into the opening 102 and the switch 80 suitably connected to wires 81, 82, 83, leading to the alarm system. The latch monitor is held in place by a conventional strike plate 110 having an opening 112 through which the bolt or latch associated with the closure can pass. As is conventional, the strike plate may be provided with a lip 116 to engage the bolt as the closure, such as a door, is pivoted to the closed position. The latch monitor is held in place by the strike plate which, in turn, is secured by fasteners such as screws 120. The slots 25, 25A are positioned to register with the holes 125, 125A in the strike plate.

Figure 3A:
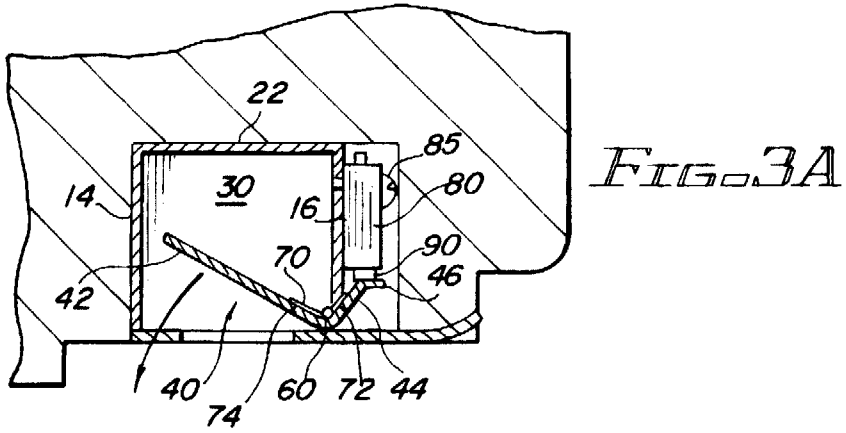
FIG. 3A is a cross-sectional view of the latch monitor showing the rocker plate in its normal, at rest position with the switch in a first condition.
Figure 3B:
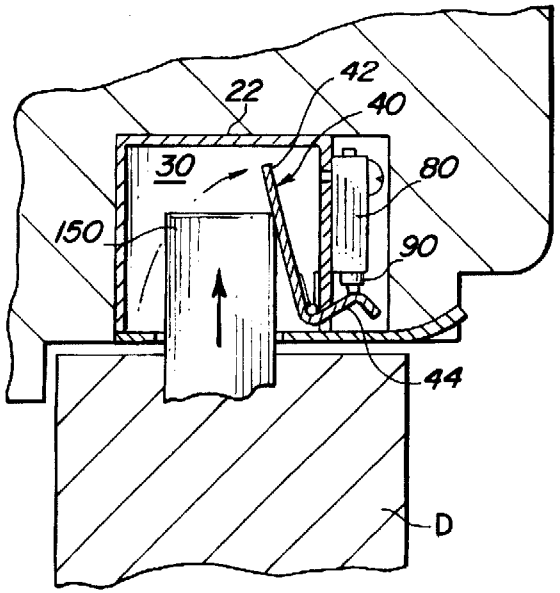
FIG. 3B is a cross-sectional view of the latch monitor in which a bolt has been extended into the strike causing the switch to move to a second condition.

In FIG. 3B, a closure, such as the door "D", is shown in the closed position and a latch or bolt, such as bolt 150, is moved or caused to be moved into the strike area 30. When this occurs, the bolt or latch 150 will strike the outer surface of the strike plate portion of the rocker plate 40 pivoting it inwardly as shown in FIG. 3B. Note the bolt or latch may enter strike area 30 at any vertical or lateral position and the rocker plate will still pivot as the rocker plate substantially occupies strike area 30. Entry of the bolt or latch will cause the flange 44 of the rocker plate to be pivoted upwardly allowing actuator 90 to extend, thereby moving the switch 80 to a second condition to provide an indication to the alarm system that the latch or bolt is in the proper engaged position. If the door is closed and the latch or bolt does not properly extend into the strike area 30 to cause the rocker plate to disengage the switch actuator, the proper alarm indication, either audio or visual, will not be provided and the occupants will be advised of a possible security problem.

Figure 2:
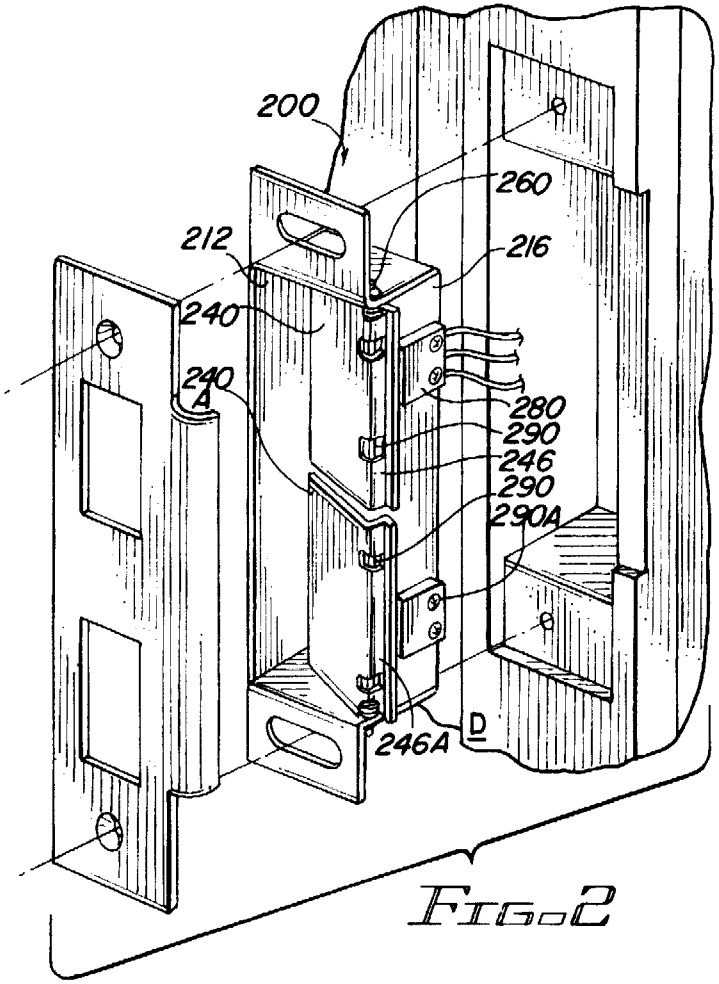
FIG. 2 is a perspective view of an alternate embodiment of the present invention, which embodiment will separately monitor a pair of latches or bolts or a combination thereof.
Figure 7:
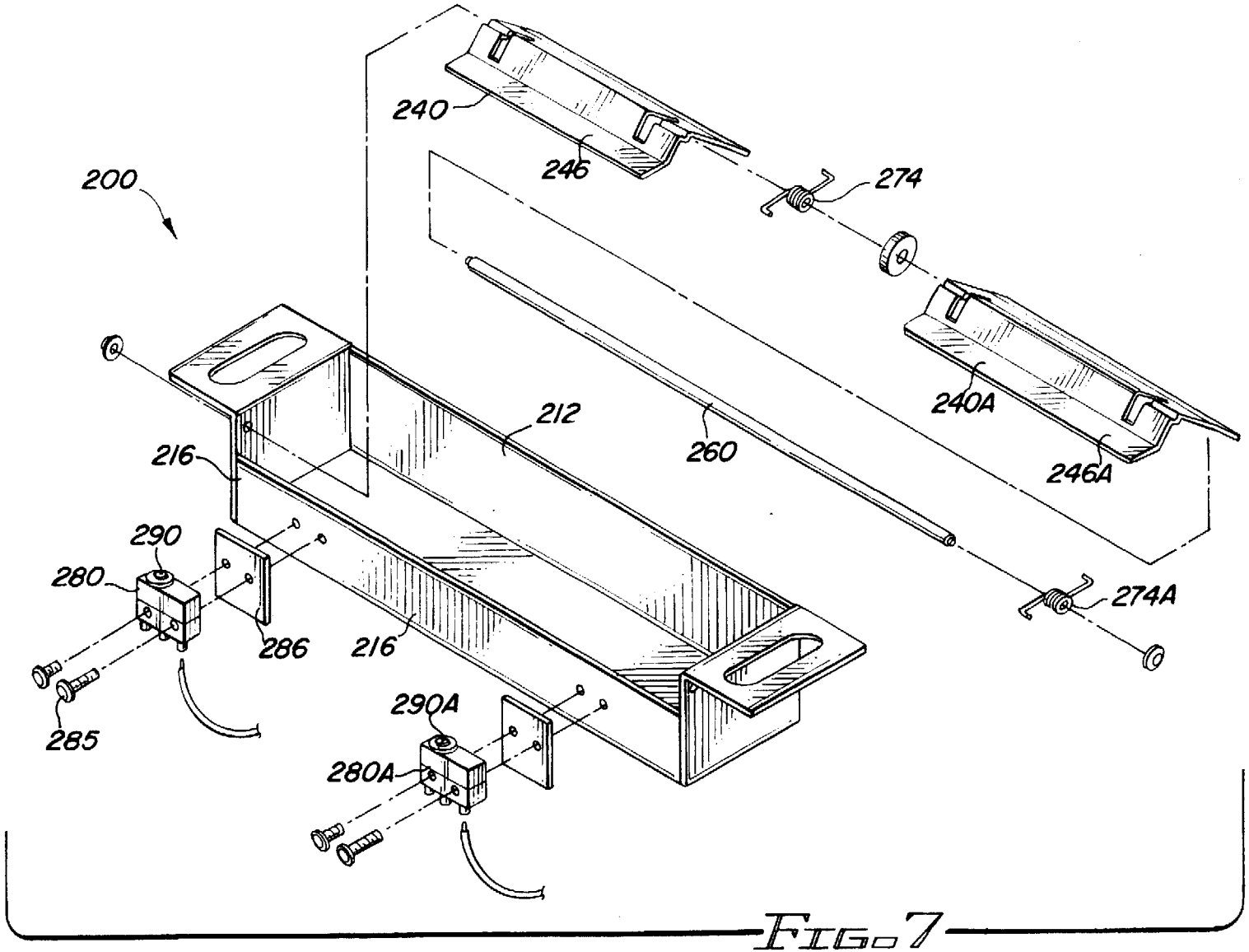
FIG. 7 is an exploded perspective view of the latch monitor shown in FIG. 2.

Turning to FIGS. 2 and 7, an alternate embodiment of the present invention is generally designated by the numeral 200 and is constructed generally as described above with reference to embodiment 10. The principle difference is that embodiment 200 is provided with a plurality of rocker plates 240 and 240A which are independently, pivotally mounted on pivot pin 260 which extends longitudinally along the side wall 216 of receptacle 212. The side wall 216 is provided with a plurality of switches 280 and 280A secured by screws 285, each switch having an actuator 290 and 290A, respectively, which in the rest position are engaged by the flanges 246, 246A of the associated rocker plate. A suitable biasing spring 274, 274A is associated respectively with each of the rocker plates to normally urge the rocker plates to a position as seen in FIG. 3A. Each of the switches 280, 280A are connected to a alarm system, as has been described above.

The embodiment 200 is installed in a manner similar as that described with respect to FIG. 1. However, the embodiment of the invention shown in FIGS. 2 and 7 can be positioned so that one of the rocker plates, as for example rocker plate 240, is engaged by a bolt and the other rocker plate 240A, is adapted to be engaged by another locking component such as a latch. Thus, the unit is considered a double unit which will monitor the latch condition and also monitor the position of the accompanying deadbolt.

Thus, it will be seen that the latch monitor of the present invention is ideal for monitoring door latch or bolt condition and communicating that condition to a local or remote monitoring device, usually an alarm system. The device provides substantial advantages over prior art devices in that it is easily installed without the requirement of any field adjustment of the components, regardless of the vertical or lateral position of the associated latch or deadbolt. The rocker plate or plates occupy substantially the entire area within the strike for reliable monitoring. Because the switch is mounted on the side of the housing, maximum throw of the latch or deadbolt with respect to housing depth is permitted. No interfering components restrict the bolt or latch. Also, the rocker plate will be pivoted with minimum bolt throw so that the device accommodates a wide range of latch designs having latches of different shapes, sizes and throw.

The design utilizes a minimum of parts and is relatively easy to manufacture, assemble and install and is reliable and rugged in use. It will be appreciated that even if a locked door is rattled violently, the force will not be transmitted to the switch since the rocker plate is out of contact with the switch when the bolt is in place. Thus, the latch monitor of the present invention is universal and will work even with installations where the latch or bolt is relatively small as the generous extension of the flapper plate into the strike area will allow the flapper to be contacted even by smaller latches or bolts.

While the principles of the invention have been made clear in the illustrative embodiments set forth above, it will be obvious to those skilled in the art to make various modifications to the structure, arrangement, proportion, elements, materials and components used in the practice of the invention. Although described in connection with doors, the invention can be used with a wide variety of closures including, but not limited to gates, windows, doors and even closures such as machine guards. To the extent that these various modifications and applications do not depart from the spirit and scope of the appended claims, they are intended to be encompassed therein.

We claim:

1. A latch monitor for mounting adjacent a closure having a reciprocal locking member comprising:

(a) a housing having a first side wall, said housing defining an open strike area;

(b) an electrical switch on said first side wall having an actuator, said switch having a first electrical condition when said actuator is actuated and a second electrical condition when said actuator is non-actuated;

(c) a rocker plate having a strike surface and a flange angularly disposed with respect to said strike surface, said rocker plate being pivotally mounted adjacent said first side wall with said strike surface extending into said strike area normally-extending substantially across the width of the strike area and said flange aligned with said actuator; and (d) biasing means acting on said rocker plate normally urging said rocker plate into engagement with said actuator whereby insertion of said locking member into said strike area will cause said strike surface of the rocker plate to be engaged by said locking member to move said rocker plate out of engagement with said actuator placing said switch in said electrical second condition.

2. The latch monitor of claim 1 wherein said housing is generally rectangular and is provided with mounting means.

3. The latch monitor of claim 1 wherein said receptacle includes a plurality of rocker plates and a plurality of switches associated with each rocker plate.

4. The latch monitor of claim 1 wherein said housing has opposite first and second side walls, opposite first and second end walls and a bottom wall and wherein said first side wall has a height less than that of said second side wall.

5. The latch monitor of claim 4 wherein said rocker plate is mounted on a pivot pin extending between the end walls and positioned spaced forward of the first side wall.

* * * * *